US007603912B2

(12) United States Patent
Schulner

(10) Patent No.: US 7,603,912 B2
(45) Date of Patent: Oct. 20, 2009

(54) METHOD FOR DETERMINING SPAN LENGTHS BASED ON PROPERTIES OF LUMBER

(75) Inventor: Thomas F. Schulner, Tacoma, WA (US)

(73) Assignee: Weyerhaeuser NR Company, Federal Way, WA (US)

( * ) Notice: Subject to any disclaimer, the term of this patent is extended or adjusted under 35 U.S.C. 154(b) by 343 days.

(21) Appl. No.: 11/424,172

(22) Filed: Jun. 14, 2006

(65) Prior Publication Data

US 2007/0289674 A1 Dec. 20, 2007

(51) Int. Cl.
*G01N 3/20* (2006.01)

(52) U.S. Cl. ..... 73/849

(58) Field of Classification Search ..... 73/796, 73/818, 826, 849
See application file for complete search history.

(56) References Cited

U.S. PATENT DOCUMENTS 1,977,971 A * 10/1934 Payzant et al. ..... 144/250.18
2,132,220 A * 10/1938 Powers ..... 52/334
4,169,173 A * 9/1979 Bergholm et al. ..... 427/284
4,195,346 A * 3/1980 Schroder ..... 700/167
4,852,029 A * 7/1989 Pope et al. ..... 702/41
5,060,516 A * 10/1991 Lau et al. ..... 73/602
5,699,274 A * 12/1997 Starostovic, Jr. ..... 702/113
6,001,452 A * 12/1999 Bassett et al. ..... 428/105
6,053,052 A * 4/2000 Starostovic ..... 73/851
6,224,704 B1 * 5/2001 Bassett et al. ..... 156/182
6,295,544 B1 * 9/2001 Cheung ..... 708/134
6,381,546 B1 * 4/2002 Starostovic ..... 702/36
6,505,129 B2 * 1/2003 Starostovic et al. ..... 702/36
6,755,297 B2 * 6/2004 Conry ..... 198/339.1
7,043,990 B2 * 5/2006 Wang et al. ..... 73/597
7,089,803 B1 * 8/2006 Scoville et al. ..... 73/856
2008/0028865 A1 * 2/2008 Steele et al. ..... 73/849

* cited by examiner

*Primary Examiner*—Lisa M Caputo
*Assistant Examiner*—Freddie Kirkland, III
(74) *Attorney, Agent, or Firm*—Rachael Vaughn

(57) ABSTRACT

Methods for determining appropriate span lengths for a given piece of lumber for use as a joist and conveying that information to a user are provided. The appropriate span length may be a function of load type, amount of load, bending stiffness, joist spacing, or the like. The span lengths may be conveyed via, for example, printing of a table onto the lumber piece itself. A user may then review the table and determine into which applications the lumber may be implemented. Accordingly, the method of the present invention enables more efficient allocation of lumber towards building needs.

21 Claims, 1 Drawing Sheet

METHOD FOR DETERMINING SPAN LENGTHS BASED ON PROPERTIES OF LUMBER

FIELD OF THE INVENTION

This invention relates generally to determining appropriate span applications for lumber given various properties of the lumber.

BACKGROUND OF THE INVENTION

Typically, joists are used to support loads in floor construction. In basic terms, a live load is a load which is not of a permanent nature, such as snow, wind, movable concentrated loads, furniture, etc. A dead load is any permanent load, such as the weight of a floor element itself, purlin, sheathing, roofing, ceiling, etc. In a span length application, all joists will be the same height and/or depth regardless of the length that is being spanned. Typically, certain design parameters are required to ensure that the floor or other application is capable of supporting the load. In the past, builders have used only premium lumber to meet the design parameters for a project. Premium lumber may be lumber which has, for example, a high modulus of elasticity. As a result, the builders have chosen to pay premium prices for this type of lumber. However, typical floor systems may have a number of locations which do not require premium lumber characteristics to meet performance specifications.

Accordingly, a need exists for determining appropriate span length applications for each individual piece of lumber to provide a more efficient allocation of all material generated by the mill. A further need exists for conveying this information to a builder.

BRIEF DESCRIPTION OF THE DRAWINGS

The embodiments of the present invention are described in detail below with reference to the following drawings.

DETAILED DESCRIPTION OF THE INVENTION

The present invention generally relates to a method for determining appropriate span lengths for a given piece of lumber for use as a joist and conveying that information to a user. The appropriate span length may be a function of load type, amount of load, bending stiffness, joist spacing, or the like. The span lengths may be conveyed via, for example, printing of a table onto the lumber piece itself. A user may then review the table and determine into which applications the lumber may be implemented. Accordingly, the method of the present invention enables more efficient allocation of lumber towards building needs.

Using a traditional approach for determining the structural acceptability of lumber joists, reference is made to the structural properties based on a statistical analysis of the general population for a given species and grade. As an example:

A "No. 2" Southern Pine 2×10 may be assigned the following values:

Bending Modulus ($F_b$)=1,050 pounds per square inch (psi)

Modulus of Elasticity (E)=1,600,000 psi

Shear Parallel to Gran ($F_v$)=175 psi

Figure 1:
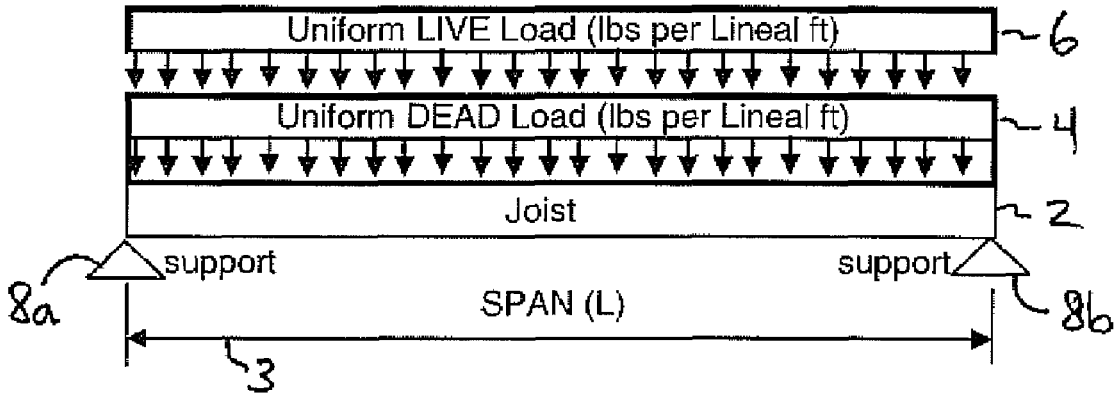
FIG. 1 is a diagram of loads being placed onto an application.

The designer assesses the load, span, and joist spacing conditions to determine the adequacy of the joist to perform structurally as required. In most cases, uniform loads are applied with specific criteria for both dead loads and live loads. FIG. 1 illustrates a cross-sectional view of sample joist and load structure. The view is lengthwise in a left-to-right direction. A joist 2 may rest on supports 8*a* and 8*b* which may rest on, for example, top surfaces of a wall. Other methods of supporting the joist may be a hanger bracket mounted to the face of a wall, a girder beam, or even a column. A minimum of 2 supports is necessary for any joist application. The joist 2 may support dead load 4. Live load 6 rests on dead load 4. The joist 2 has a span length 3 which is defined by the unsupported length.

The following variables are used in the design equations:

$W_{LL}$=Live load in lbs/LF=Design Live Load pounds per square foot (psf)×Joist Spacing"/12"

$W_{DL}$=Dead load in lbs/LF=Design Dead Load (psf)×Joist Spacing"/12"

B=Thickness of material (typically 1½" for dimension lumber)

D=Width of material (3½", 5½", 7¼", 9¼", 11¼" for dimension lumber, as seen in various embodiments)

L=Clear span of lumber from center of bearing to center of bearing

In the National Design Specification for Wood Construction, a number of adjustment factors are applied based on the size, moisture content, repetitive use, and types of loads. However, for the purposes of this example, these factors will be ignored for simplicity of explanation.

Figure 2:
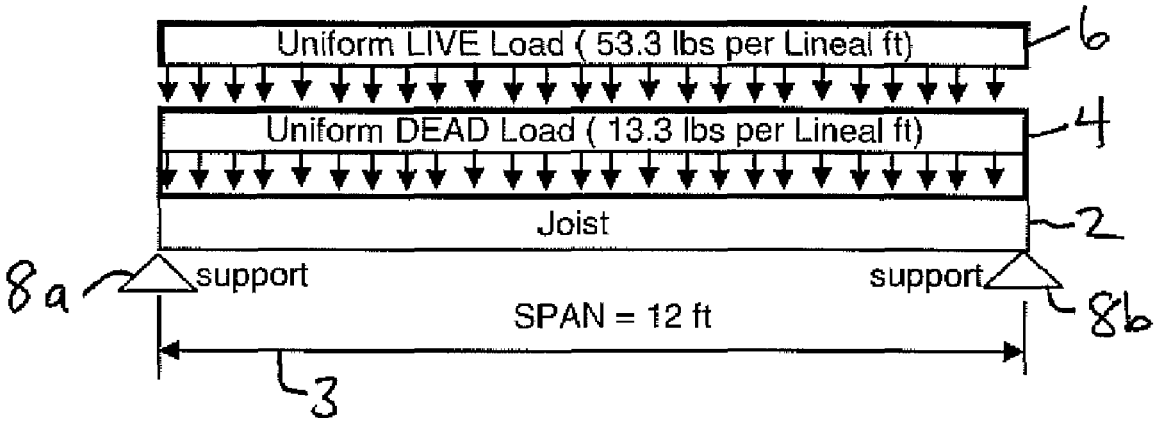
FIG. 2 is a diagram of loads being placed onto an application in an embodiment of the present invention.

The following example, illustrated in FIG. 2, will be used to generally describe the design process:

Example 1

A designer has a floor span length of 12 feet and wishes to use No. 2 Southern Pine Nominal 2 inch×10 inch lumber as joists 2 spaced 16 inches apart. The loading criteria are 40 pounds per square foot (psf) live load and 10 psf dead load. The National Design Specification for Wood Construction states that the maximum allowable deflection under full live load conditions is defined by the equation:

$$\text{Maximum Allowable Deflection}=L/360$$

in which the span (L) is divided by 360. In this example, the span of 12 feet is equal to 144 inches. 144 in/360 is equal to 0.40 in. In other embodiments, a value less than or approximately equal to L/120 may be used.

A first step is to determine if the product selected is adequate for the load criteria. The structural bending strength required of the joist is first evaluated by applying the combined Dead and Live loads. In this example, the maximum bending moment is computed by applying principles of statics for a simple span beam with the equation:

$$M_{(MAX)}=(W_{LL}+W_{DL})\times((L^2)/8)$$

The maximum stress ($f_b$) is then computed by dividing the maximum bending moment by the section modulus of the lumber size ($S_x$) where $$S_x=(BD^2)/6$$

Thus, the equation is:

$$(f_b)=M_{(MAX)}/S_x$$

This result is then compared to the allowable stress. If the value is less, then the product is acceptable. For this specific application, the bending stress ($f_b$) is computed to be 673 psi which is considerably less than our original allowable Bending Modulus ($F_b$) for the grade of the lumber chosen, defined as 1,050 psi. Therefore, the product selected is acceptable from a bending strength standpoint.

The deflection criteria are then evaluated using the same principles of statics and addressing the uniform live load portion only. The equation for maximum deflection which is located at mid-span, or the midpoint of the span, is expressed as:

$$\text{Maximum Deflection at Mid Span}=(5\times W_{LL}\times(L^4))/(384\times E\times I)$$

where I is the Moment of Inertia of the lumber size selected using the equation:

$$I=(1/12)\times(B\times D^3)$$

The computed deflection for a piece of lumber from this grade is then compared against the deflection criteria to determine if it is less. In this example, the computed deflection is 0.16 inches which is considerably less than the original maximum allowable deflection criteria of 0.4 inches.

Based on the initial investigation, the example demonstrates that using the general design values, the product as selected will meet the design criteria. Although there are a number of additional design steps to take to be certain that the product is acceptable, in generally most cases, these two criteria checks may be sufficient to establish that the product is adequate for floor joist or other applications.

As demonstrated above, applying the published stress values for the product grade selected above shows that this product is sufficiently adequate for the application selected. Using advanced grading technologies, i.e., machine grading equipment and systems known to those skilled in the art, specific design values can be assigned to an individual piece of lumber rather than just allocating it into a "general grade" of lumber as is commonly seen in the industry. These types of machine grading equipment can include, but are not limited to, stress grading systems, systems which measure stiffness through time of flight of stress waves, resonant frequency type systems, sensor group systems which obtain moisture content measurement, electrical property measurement, structural property measurement, acousto-ultrasonic property measurement, light scatter (tracheid-effect) measurement, grain angle measurement, shape measurement, color measurement, spectral measurement and/or defect maps, and any other systems known to those skilled in the art for measuring structural properties and/or grading a wood-containing product. Based on the example above, any nominal 2 in×10 in piece of lumber with an allowable bending stress greater than 673 psi and a Modulus of Elasticity sufficient to sustain less than 0.4 inches of live load deflection would be adequate for this span, spacing, and design criteria.

By algebraically changing the formulas above to isolate the span (L) as the dependent variable, the maximum allowable span can be computed for which an individual board can be used based on the unique stress and stiffness characteristics of the piece. The product can then be, for example, trimmed, sorted, and packaged into common packages based on end use performance. Thus in an embodiment, a method is provided for grouping together a plurality of lumber to be installed in an application having one or more structural requirements. At least one of the structural requirements is span length. The method comprising the steps of: determining one or more recommended span lengths for a piece of lumber wherein the span lengths are based on: (a) a bending modulus calculated for the piece of lumber; (b) a modulus of elasticity calculated for the piece of lumber; (c) joint spacing for the application; and (d) a load amount to be placed on the application; and combining the piece of lumber with other pieces of lumber to create the plurality of lumber wherein the plurality of lumber meets one or more of the structural requirements of the application.

A span table can be stamped or otherwise placed on each individual board providing the end user specific criteria for which the product would be acceptable. The following is an example of a span table as it may appear on an individual piece of lumber:

TABLE 1

Weyerhaeuser Span Rated Floor Joists
Live load deflection for this 2 × 10 will be less than L/360
When installing this product to spans no longer than stated in this table. (feet-inches)

| Joist Spacing | 30 PSF Live Load | | 40 PSF Live Load | | 50 PSF Live Load | |
|---|---|---|---|---|---|---|
| (inches) | 10 psf DL | 20 psf DL | 10 psf DL | 20 psf DL | 10 psf DL | 20 psf DL |
| 12 | 17 Ft 6 In | 17 Ft 4 In | 15 Ft 11 In | 15 Ft 10 In | 14 Ft 9 In | 14 Ft 8 In |
| 16 | 15 Ft 11 In | 15 Ft 0 In | 14 Ft 6 In | 13 Ft 8 In | 13 Ft 5 In | 12 Ft 8 In |
| 19.2 | 15 Ft 0 In | 13 Ft 8 In | 13 Ft 7 In | 12 Ft 6 In | 12 Ft 6 In | 11 Ft 7 In |
| 24 | 13 Ft 8 In | 12 Ft 3 In | 12 Ft 3 In | 11 Ft 2 In | 11 Ft 2 In | 10 Ft 4 In |

The table takes both the deflection criteria for live load deflection and the flexural bending strength of the combined live and dead loads into account. A field may be provided for displaying the computed deflection criteria, as illustrated above (i.e., in the area shown as "L/360"). Proprietary criteria may be used in lieu of the generally accepted "L/360" in order to provide specific performance ratings as required in special product applications. The table may also have, for example, fields to display the dimensions of lumber, as shown above (i.e., the "2×10" reference to a piece of lumber having nominal dimensions of 2 inches by 10 inches). In an embodiment, the table is coded to convey that a span length is near a structural limit for the piece of lumber. The code may be in the form of a color code, for example. For example, a first color may indicate a safe range for the span length and/or application. A second color may indicate a length which approaches a structural limit which should not be exceeded for risk of structural failure. Various sections may be provided corresponding to various loads. Other sections may be provided for span lengths corresponding to the spacing of the joists. It is understood that data for the table may be gathered at various stages during grading of the lumber and processed by a central processing unit, or network of units, to create the table.

In an embodiment, the table may be printed electronically onto the piece of lumber. Other embodiments are contemplated in which the table is displayed on the piece of lumber, such as printing on a sheet which is attached to the piece, or any other methods and/or systems for providing indicia on a piece of lumber known by those skilled in the art.

While the embodiments of the invention have been illustrated and described, as noted above, many changes can be made without departing from the spirit and scope of the invention. Accordingly, the scope of the invention is not limited by the disclosure of the embodiments. Instead, the invention should be determined entirely by reference to the claims that follow.

What is claimed is:

1. A method for communicating a recommended span length for a piece of lumber to be installed in an application, the method comprising the steps of:

creating a span table on the piece of lumber containing two or more allowable span lengths for the piece of lumber wherein the span lengths are based on:

(a) a bending modulus calculated for the piece of lumber; and (b) a modulus of elasticity calculated for the piece of lumber;

displaying the table on the piece of lumber;

wherein the span table has one or more rows, each of the one or more rows displaying two or more allowable span lengths for a given joist spacing; and wherein the span table has a plurality of sections, each of the plurality of sections corresponding to a load to be placed on the application.

2. The method of claim 1 wherein the span table is printed electronically.

3. The method of claim 1 wherein the load is a live load, dead load, or a combination of both.

4. The method of claim 1 wherein the piece of lumber is machine stress graded prior to creating of the table.

5. The method of claim 1 wherein the span table is coded to convey that a span length is near a structural limit for the piece of lumber.

6. The method of claim 5 wherein the span table is color-coded.

7. The method of claim 1 wherein the application requires two or more pieces of lumber, and wherein the span lengths are further based on joist spacing between respective pieces of lumber for the application.

8. The method of claim 1 wherein the piece of lumber is a joist.

9. The method of claim 1 wherein a maximum allowable deflection for the application is equal to the two or more allowable span lengths divided by a value greater than or equal to 120.

10. A method for grouping together a plurality of lumber to be installed in an application having one or more structural requirements wherein at least one of the structural requirements is span length, the method comprising the steps of:

determining two or more recommended span lengths for a piece of lumber wherein the span lengths are based on:

(a) a bending modulus calculated for the piece of lumber; and (b) a modulus of elasticity calculated for the piece of lumber;

combining the piece of lumber with other pieces of lumber to create the plurality of lumber wherein the plurality of lumber meets one or more of the structural requirements of the application; and displaying a span table on the piece of lumber showing the one or more recommended span lengths for a piece of lumber;

wherein the span table has one or more rows, each of the one or more rows displaying two or more allowable span lengths for a given joist spacing a maximum allowable deflection for the application is equal to span length divided by a value greater than or equal to 120; and wherein the span table has a plurality of sections, each of the plurality of sections corresponding to a load to be placed on the application.

11. The method of claim 10 wherein the span table is printed electronically.

12. The method of claim 10 wherein the span table is coded to convey that a span length is near a structural limit for the piece of lumber.

13. The method of claim 10 wherein the load is a live load, dead load or a combination of both.

14. The method of claim 10 wherein the bending modulus or the modulus of elasticity are determined via machine testing.

15. The method of claim 10 wherein the table has sections displaying span lengths corresponding to joist spacings.

16. A lumber product comprising:

one or more pieces of lumber to be used in an application; and one or more span table displayed on each of the one or more pieces of lumber; wherein each of the one or more span table displays two or more allowable span lengths for the one or pieces of lumber, the two or more allowable span lengths being calculated based on:

a bending modulus calculated for the one or more pieces of lumber; and a modulus of elasticity calculated for the one or more pieces of lumber;

wherein the one or more span tables each have one or more rows, each of the one or more rows displaying two or more allowable span lengths for a given joist spacing; and wherein the span table has a plurality of sections, each of the plurality of sections corresponding to a load to be placed on the application.

17. The lumber product of claim 16 wherein the one or more span tables are printed electronically.

18. The lumber product of claim 16 wherein the one or more span tables are stamped on the one or more pieces of lumber.

19. The lumber product of claim 16 wherein the one or more span tables are printed on one or more stickers, the one or more stickers being attached to the one or more pieces of lumber.

20. The lumber product of claim 16 wherein the one or more span tables are color-coded.

21. The lumber product of claim 16 wherein the load is a live load, dead load, or a combination of both.

* * * * *